US009724712B2

(12) United States Patent
Bloc

(10) Patent No.: US 9,724,712 B2
(45) Date of Patent: Aug. 8, 2017

(54) DISPENSING HEAD FOR A SYSTEM FOR DISPENSING A PRODUCT

(71) Applicant: ALBEA LE TREPORT, Le Treport (FR)

(72) Inventor: Richard Bloc, Derchigny-Graincourt (FR)

(73) Assignee: ABLEA LE TREPORT, Le Treport (FR)

( * ) Notice: Subject to any disclaimer, the term of this patent is extended or adjusted under 35 U.S.C. 154(b) by 0 days.

(21) Appl. No.: 14/974,026

(22) Filed: Dec. 18, 2015

(65) Prior Publication Data

US 2016/0175863 A1 Jun. 23, 2016

(30) Foreign Application Priority Data

Dec. 18, 2014 (FR) ..... 14 62837

(51) Int. Cl.
*B05B 11/00* (2006.01)
*B05B 15/02* (2006.01)
*B65D 83/14* (2006.01)

(52) U.S. Cl.
CPC ..... *B05B 11/007* (2013.01); *B05B 11/0005* (2013.01); *B05B 11/3047* (2013.01); *B05B 15/02* (2013.01); *A45D 2200/057* (2013.01); *B65D 83/7535* (2013.01)

(58) Field of Classification Search
CPC ... B05B 11/007; B05B 15/02; B05B 11/3047; B05B 11/0005; A45D 2200/057; B65D 83/7535
USPC ..... 222/321.1–321.9, 383.1, 383.3
See application file for complete search history.

(56) References Cited

U.S. PATENT DOCUMENTS 6,145,707 A 11/2000 Baudin
2003/0155379 A1 8/2003 Masuzzo et al.
2008/0093387 A1* 4/2008 Pivonka ..... A45D 34/04 222/205

(Continued)

FOREIGN PATENT DOCUMENTS

EP 0908395 4/1999
EP 1327477 7/2003

(Continued)

OTHER PUBLICATIONS

French App No. 1462837, Search Report, mailed Jul. 31, 2015.

*Primary Examiner* — Donnell Long
(74) *Attorney, Agent, or Firm* — Banner & Witcoff, Ltd.

(57) ABSTRACT

A dispensing head for a system for dispensing a product, having a body having a well for mounting the head on a tube for the pressurized supply of the product and a recess in communication with the well by means of a dispensing path. The recess being equipped with a nozzle delimiting a dispensing space between the path and a discharge passage formed in the nozzle. The nozzle being equipped with an insert that has a membrane forming, in the space, a communication interface between an upstream part in which the path emerges and a downstream part that supplies the discharge passage. The membrane being reversibly deformable by the product exerting pressure coming from the upstream part, between a resting state in which the size of the interface is minimal and a stressed state in which the size of said interface is increased in order to provide dispensing.

19 Claims, 3 Drawing Sheets

(56) References Cited

U.S. PATENT DOCUMENTS

2014/0299679 A1 10/2014 Bloc et al.

FOREIGN PATENT DOCUMENTS

FR 2990931 A1 11/2013
WO 2013072635 5/2013

* cited by examiner

DISPENSING HEAD FOR A SYSTEM FOR DISPENSING A PRODUCT

CROSS REFERENCE TO RELATED APPLICATIONS

This application claims priority to French Application Serial No. 1462837, filed Dec. 18, 2014, which is hereby incorporated by reference.

FIELD

The invention relates to a dispensing head for a system for dispensing a product, the dispensing system comprising such a head fixed to a tube for the pressurised supply of the product, and a bottle intended to contain a product to be dispensed by means of such a dispensing system.

In a particular application, the fluid product is of the lotion, gel or cream type, for example for use in cosmetics or for pharmaceutical treatments.

BACKGROUND

Dispensing systems are known which comprise a pump provided with a tube for the pressurised supply of the product, on which a dispensing head of the pushbutton type is fixed in order to actuate the movement of said tube over a dispensing stroke and to actuate the suction of the product.

In particular, the dispensing head may comprise a body having a well for mounting said head on the supply tube and a product dispensing path. According to one embodiment, the dispensing path emerges in a dispensing space formed in a nozzle having a product discharge passage. Thus, by pressing on the body of the dispensing head, the pump is actuated in order to dispense the product through the discharge passage as a small amount or as a continuous stream.

Throughout the world, various directives aim to regulate, control or limit the presence of substances that are potentially hazardous for human health in products, in particular cosmetic products. One of them is the European Directive REACh (Registration Evaluation and Authorisation of Chemicals). Thus an environmental trend is pushing cosmetics manufacturers to limit, or even eliminate from the formulae, preservatives that are often the cause of allergies or intolerances.

Cosmetic products are therefore becoming more and more fragile. In particular, it is difficult for them to withstand mechanical or thermal stress (causing for example phase separation), contact with air (causing for example drying or oxidation), and are easily contaminated by bacteria, yeasts and moulds.

To combat such contaminations, formulators attempt to reinforce the intrinsic preservative activity of their products by adding ingredients having a preservative activity, such as certain essential oils, orange essences, vitamin C, etc., which are not declared as preservatives. Thus they limit the free activity of water, which they attempt to keep low (AW<0.6) so that bacteria do not develop or only develop a little. The standard NF 29621 describes such means. However, formulators quickly come up against the limits of such a strategy.

On the other hand, both with regard to the container in which the product is packaged and with regard to the dispensing head, protective bottles are appearing on the market. In particular, the bottles must prevent the microbiological contamination of the product, not only during storage but especially between two uses, and in particular by back contamination from the discharge passage towards the inside of the container through the dispensing space.

To do this, dispensing heads have been proposed where the discharge passage is equipped with a membrane that can be deformed by the product exerting pressure thereon, between a closed and open state of the discharge passage respectively. In particular, the impermeability of the closure between two dispensings can be achieved by pressing the flexible membrane on a rigid geometry.

However, this strategy finds its limit in the fact that it is impossible to obtain a sufficiently close pressing interface to prevent contaminants of very small sizes entering the dispensing space through said interface.

Furthermore, the membrane pressed in the discharge passage is in direct contact with the outside air, giving rise to a risk of rapid drying of the small quantity of product disposed at the sealing interface. Thus, between two uses, all the more so if relatively spaced apart in time, the membrane has a tendency to stick in the closed state, actuation of the dispensing causing a pressurisation of the product in the dispensing space to a sufficient level to cause detachment, then leading to an abrupt discharge of the product through the passage thus opened.

SUMMARY

The invention aims to improve the prior art by proposing in particular a dispensing head of simple design in which the dispensing of the product is provided while avoiding microbial contamination thereof between two uses, in particular by back contamination from the discharge passage to the inside of the container, and this while maintaining gradual retrieval of the product during the actuation of the dispensing, even after a relatively prolonged time of non-use.

To this end, according to a first aspect, the invention proposes a dispensing head for a system for dispensing a product, said head comprising a body having a well for mounting said head on a tube for the pressurised supply of the product and a recess in communication with said well by means of a dispensing path, said recess being equipped with a nozzle delimiting a dispensing space between said path and a discharge passage formed in said nozzle, the nozzle being equipped with an insert that has a membrane forming, in the dispensing space, a communication interface between an upstream part in which the dispensing path emerges and a downstream part that supplies the discharge passage, said membrane being reversibly deformable by the product exerting pressure coming from the upstream part, between a resting state in which the size of the communication interface is minimal and a stressed state in which the size of said interface is increased in order to provide dispensing, said nozzle preferentially being able to provide microbiocidal or at least microbiostatic action on the product contained at least in the downstream part of the dispensing space.

According to a second aspect, the invention proposes a system for dispensing a product, said system comprising such a dispensing head and a tube for the pressurised supply of the product, to which the well for mounting said head is fixed.

According to a third aspect, the invention proposes a bottle comprising a container in which a product is intended to be packaged, said container being equipped with such a dispensing system, which is mounted so as to put the supply tube in communication with said container to allow the product to be routed from said supply tube to the discharge passage.

BRIEF DESCRIPTION OF THE DRAWINGS

Other objects and advantages of the invention will emerge in the following description given with reference to the accompanying drawings, in which.

DETAILED DESCRIPTION

Figure 1:
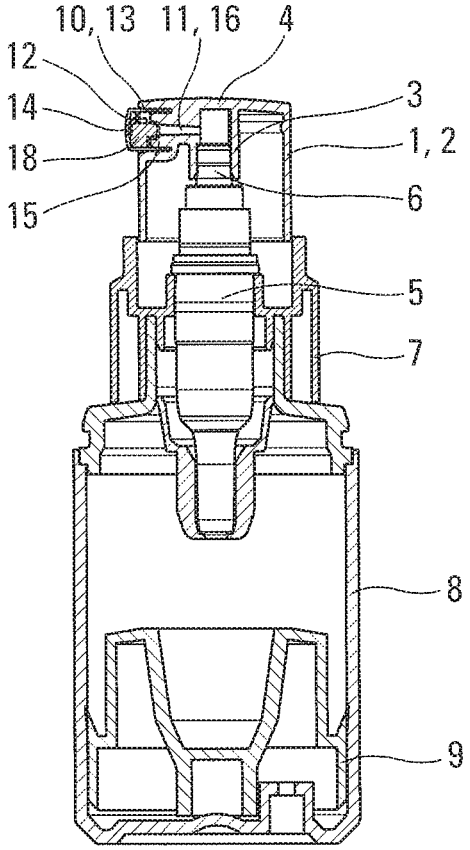
FIG. 1 is a view in longitudinal section of a dispensing bottle according to an embodiment of the invention.
Figure 2A:
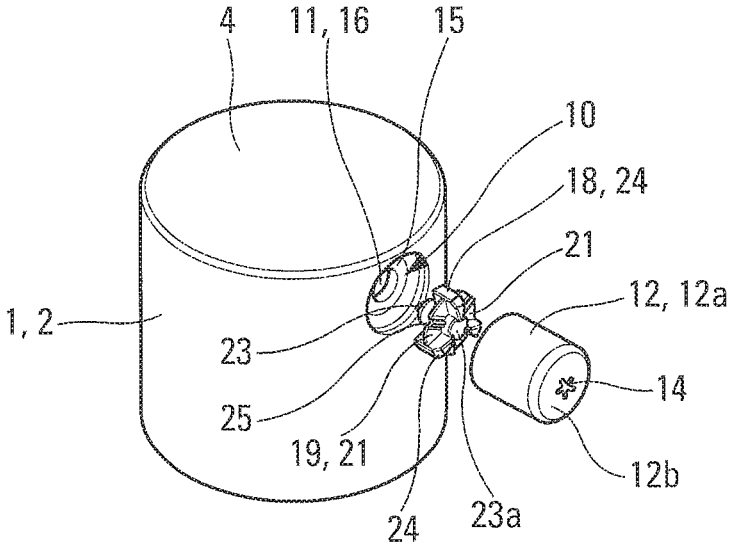
FIG. 2*a* is an exploded perspective view and FIG. 2*b* is a longitudinal section of the dispensing head of the bottle of FIG. 1.
Figure 2B:
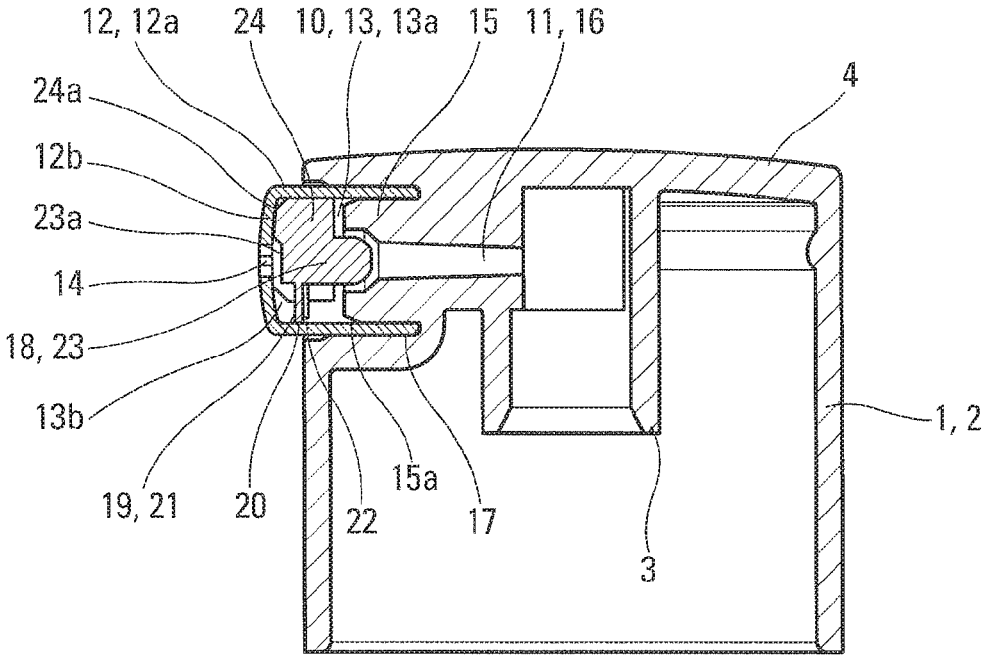

In relation to the drawings, a description is given of a dispensing head of the pushbutton type for a system for dispensing a pressurised product, for example as a small amount or as a continuous stream. In an example of an application, the fluid product is a lotion, a gel or a cream, for cosmetic use or for pharmaceutical treatments.

The dispensing head comprises a body 1 having an annular skirt 2 that surrounds a well 3 for mounting said head on a tube for the pressurised supply of the product. In addition, the dispensing head comprises an upper region 4 allowing the user to exert pressure on said head using their fingers in order to be able to move it axially.

The dispensing head is intended to equip a dispensing system that comprises a extraction device 5 provided with a tube 6 for the pressurised supply of a product to be dispensed, on which the well 3 for mounting said head is fixed sealingly to allow, by axial movement of said head, said tube to move over a dispensing stroke and to actuate the suction of the product.

The extraction device 5 of the dispensing system may comprise a manually actuated pump or, where the product is packaged under pressure, a manually actuated valve. Thus, during a manual movement of the dispensing head, the pump or the valve is actuated in order to feed the tube 6 for the pressurised supply of the product.

In particular, a manually actuated pump conventionally comprises a body in which means necessary for pressurising the product to be dispensed are disposed. According to a particular embodiment, the pump is of the type without an air intake in compensation for the volume of product dispensed, so as not to introduce any contaminant into the packaged product.

In a known manner, the dispensing system further comprises means, for example a collar 7, to make it possible to mount it on the container of a bottle 8 in which a product to be dispensed is intended to be packaged, as well as means for supplying the extraction device 5 with packaged product, for example a dip tube disposed in the container or, as shown in FIG. 1, a supply piston 9 which is slidably mounted in the body of said container so as to collect the product in said extraction device.

The body 1 also has an annular recess 10 that is in communication with the mounting well 3 by means of a dispensing path 11. In the embodiment shown, the recess 10 has its axis perpendicular to that of the mounting well 3 to allow lateral dispensing of the product relative to the body 1. In a variant that is not shown, the recess may be colinear with the mounting well, in particular for a dispensing head forming a dispensing nasal end piece.

The recess 10 is equipped with a nozzle 12 delimiting a dispensing space 13 between the dispensing path 11 and a discharge passage 14 formed in said nozzle. In the embodiment shown, the recess 10 is provided with an abutment 15 around which the nozzle 12 is mounted in order to delimit the dispensing space 13, said abutment having at least one conduit 16 in which at least part of the dispensing path 11 extends. In particular, the conduit 16 extends axially in the central part of the abutment 15, in order to allow central supply of the dispensing space 13.

Thus, by fixing the mounting well 3 on the supply tube 6, the product is dispensed by pressing on the body 1 in order to actuate the movement of said tube in order to convey the packaged product from the supply tube 6 to the discharge passage 14.

The dispensing head may also be used for other types of dispensing. In particular, the container of the bottle 8 may comprise a flexible body, the pressurisation of the product in the supply tube then taking place by moving the walls of said container together, without using a pump.

In the embodiments shown, the nozzle 12 has a lateral wall 12*a* that is cylindrical in revolution and is closed towards the front by a distal wall 12*b* in which the discharge passage 14 is formed.

The association of the nozzle 12 in the recess 10 is achieved by fitting in the lateral wall 12*a*. To do this, the abutment 15 has a chamfer 15*a* formed on its front end. Furthermore, the bottom of the recess 10 has a channel 17 that surrounds the abutment 15 and in which a rear part of the lateral wall 12*a* is disposed in order to be mounted in gripping contact between said abutment and a lateral wall of the recess 10.

Advantageously, at least the lateral wall 12*a* of the nozzle 12 may be produced from a material the rigidity of which is greater than the rigidity of the material forming the body 1. Thus the high stiffness of the lateral wall 12*a* prevents deformation thereof when it is mounted in the recess 10. Furthermore, the lesser stiffness of the body 1 affords improved sealing between the mounting well 3 and the supply tube 6.

The nozzle 12 is also equipped with an insert 18 that has a membrane 19 forming, in the dispensing space 13, a communication interface 20 between an upstream part 13*a* in which the distribution path 11 emerges and a downstream part 13*b* that supplies the discharge passage 14.

In particular, the membrane 19 is reversibly deformable by the product exerting pressure coming from the upstream part 13*a*, between a resting state in which the size of the communication interface 20 is minimal and a stressed state in which the size of said interface is increased in order to provide dispensing of the product.

To do this, the insert 18 is produced from a flexible material, in particular based on a thermoplastic elastomer (TPE) and/or a low-density polyethylene (LDPE), such materials having good properties in terms of reversible deformation.

The membrane 19 has at least one deformable web 21 delimiting a communication interface 20 with an internal bearing surface 22 extending over the internal face of the lateral wall 12*a*, said web being arranged so as to flex by the product exerting pressure thereon, causing a reduction in the outer dimension of said web.

The insert 18 also has a central stud 23 around which the web 21 of the membrane 19 extends radially. In particular, the insert 18 is disposed in the dispensing space 13 so that the central conduit 16 of the abutment 15, and therefore the dispensing path 11, emerges axially opposite the central stud 23, which allows even angular distribution of the product emerging from said path in the upstream part 13*a* of the dispensing space 13.

According to one embodiment, the membrane 19 has at least two and in particular three webs 21 that each extend over an angular sector while being separated angularly by a bridge 24, the rigidity of which is greater than that of said webs, in particular in order not to flex by the product exerting pressure thereon.

In relation to the figures, the bridges 24 extend radially from the periphery of the central stud 23 while being equally distributed angularly, so that the webs 21 have identical angular dimensions. Thus, because of their identical arrangement and the even angular distribution of the product in the upstream part 13*a*, the webs 21 subjected to the pressure of said product deform evenly to allow a substantially symmetrical increase in the size of the communication interface 20.

Figure 4A:
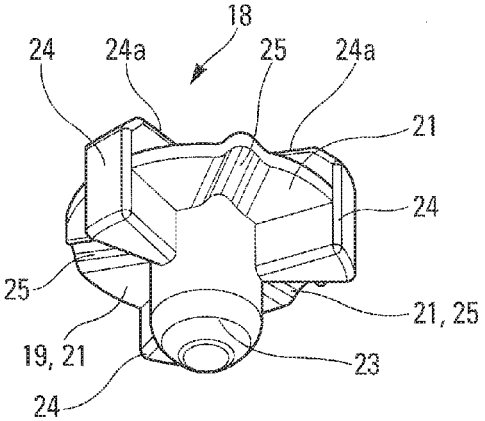
FIG. 4*a* is a perspective view from the rear and FIG. 4*b* is a perspective view from the front of the insert equipping the dispensing head of FIG. 2*b;*
Figure 4B:
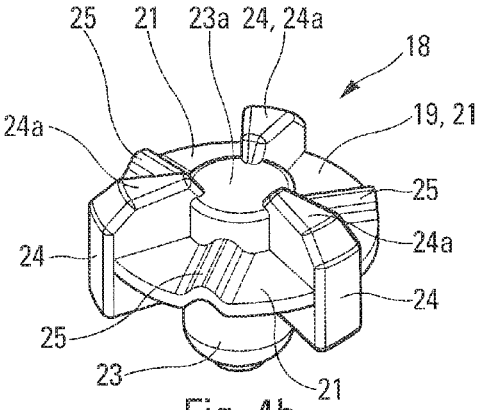
Figure 5A:
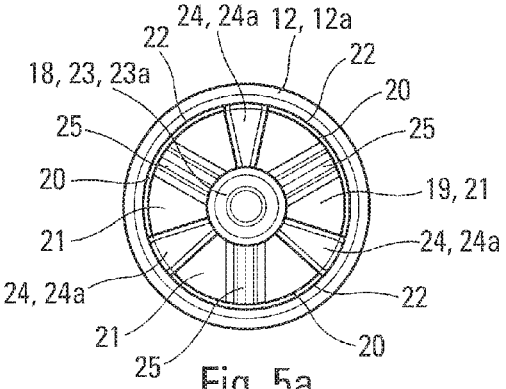
FIGS. 5*a*, 5*b*, 6*a*, and 6*b* are representations of the arrangement of the insert in FIGS. 4*a* and 4*b* in the nozzle of FIG. 3, showing the insert in the resting state (FIGS. 5*a* and 5*b*) and in the stressed state (FIGS. 6*a* and 6*b*), respectively in rear view (FIG. 5*a*, 6*a*) and in longitudinal section (FIG. 5*b*, 6*b*).
Figure 6A:
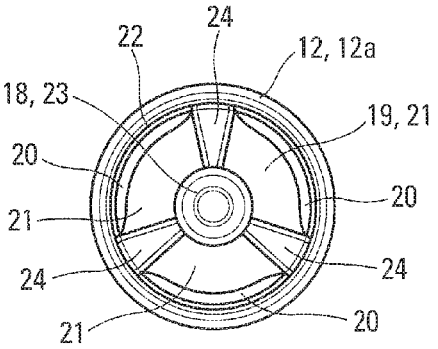
Figure 6B:
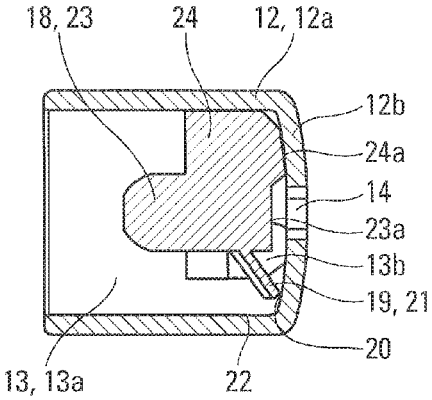

As shown in particular in FIG. 4, each web 21 has a bellows 25 arranged so as to control its deformation under the effect of the pressure of the product. In particular, in relation to FIGS. 6*a* and 6*b*, the bellows 25 are arranged so that the membrane 19 in a stressed state comes into axial abutment on the inside of the distal wall 12*b* while maintaining a communication interface 20 between said abutment and said wall.

Furthermore, the bridges 24 each extend from a front portion of the central stud 23 and each have a front stop 24*a* that is in axial abutment on the inside of the distal wall 12*b*, in particular under the effect of the pressure exerted by the product on the webs 21. In particular, the front stops 24*a* extend axially beyond the front end 23*a* of the central stud 23, so as to prevent said front end coming to close off the discharge passage 14, in particular in the case of high pressure of the product in the upstream part 13*a*.

Between two dispensings, product may remain immobilised in the dispensing space 13, putting it in contact with the outside air potentially contaminating through bacteria and/or fungi. Thus, by back diffusion from the discharge passage 14 into the dispensing space 13, at least the dose of product to be dispensed subsequently may be contaminated.

To limit this contamination, the nozzle 12 is also able to provide microbiocidal or at least microbiostatic action on the product contained at least in the downstream part 13*b* of the dispensing space 13. This is because, as a result of the presence of the insert 18 and the proximity of the discharge passage 14, the product contained in the downstream part 13*b* is more exposed to the outside air than the product contained in the upstream part 13*a*, and therefore has greater risk of contamination by said outside air.

To do this, at least the surfaces of the nozzle 12 that delimit the downstream part 13*b*, that is to say the internal surface of the distal wall 12*b* and the internal bearing surface 22 delimiting the communication interface 20, are arranged to provide microbiocidal or at least microbiostatic action on the product. In a variant, the entire internal face of the lateral wall 12*a* may be arranged so as to be able to provide microbiocidal or at least microbiostatic action on the product in order also to afford decontamination of the product contained in the upstream part 13*a*.

Advantageously, the external surface of the distal wall 12*b* is also able to provide a microbiocidal or at least microbiostatic function to prevent contamination by any dirt disposed thereon during two dispensings, thus ensuring that the product dispensed subsequently is not contaminated by said dirt.

Likewise, the lateral wall 14*a* delimiting the discharge passage 14 may be suitable for fulfilling a microbiocidal or at least microbiostatic function since the product contained in the downstream part 13*b* between two dispensings is also in contact with the outside air.

Figure 3:
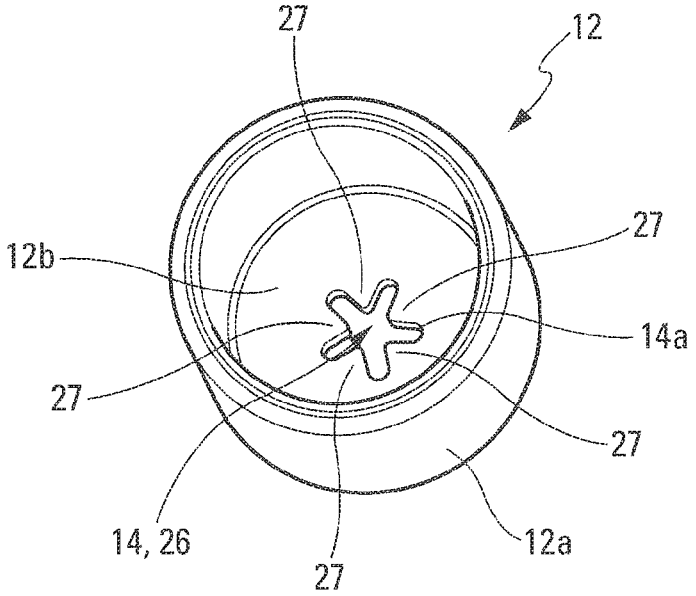
FIG. 3 is a perspective view showing the inside of the nozzle equipping the dispensing head of FIG. 2*a;*

In relation to FIG. 3, the discharge passage 14 has an opening 26 that is delimited by a lateral wall 14*a* provided with at least one internal projection 27, and in particular five internal projections 27, which makes it possible to dispense the product in the form of a stiffened layer. Thus, when the lateral wall 14*a* is able to fulfil a microbiocidal or at least microbiostatic function, a stiffening of the layer of product to be dispensed by means of the lateral projections 27 is combined with action against the contamination of the product of said layer by bacteria, yeasts and moulds.

In particular, decontamination is ensured of the product which, between two dispensings, is located in the vicinity of the discharge passage 14, and entry of bacteria, yeasts and moulds in the bottle 8 by means of the dispensing path 11 is prevented.

Moreover, because of the minimal size of the communication interface 20 between two dispensings, the passage, in the upstream part 13*a*, of contaminants of very small size coming from outside, and all the more so of the product remaining in the downstream part 13*b* that is potentially infested thereby, is limited. Thus the risk of back contamination from the discharge passage 14 to the inside of the container is limited.

Furthermore, since the membrane 19 regulating the passage of product to be dispensed is disposed in the nozzle 12, that is to say in a relatively closed space, the contact of said membrane with the outside air is limited, which makes it possible to reduce the risk of drying of the small quantity of product disposed at the interface 20 formed by said membrane. Thus the risk of adhesion of the membrane 19 to the internal bearing surface 22 in the resting state, and therefore the risk of overpressure and abrupt discharge of the product to be dispensed subsequently, is limited.

Figure 5B:
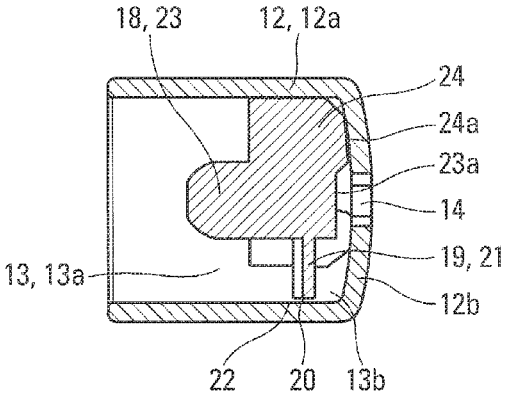

In order to further limit the risk of adhesion of the membrane 19 to the internal bearing surface 22, the web 21 has, in relation to FIG. 5*b*, an external size at rest that is less than the internal size of the internal bearing surface 22, in order to prevent said web being put in contact with said internal bearing surface.

In a variant, the web 21 may have an external size at rest that is substantially equal to the internal size of the bearing surface 22. Thus the size at rest of the communication interface 20 is substantially zero, which makes it possible to limit to the maximum extent the passage in the upstream part 13*a* of external contaminants and/or undispensed and potentially contaminated product.

Moreover, the insert 18 may also be able to provide microbiocidal or at least microbiostatic action on the product contained at least at the communication interface 20. In particular, the insert 18 may entirely consist of a material having microbiocidal or at least microbiostatic properties, so as to participate with the nozzle 12 in the decontamination of the product remaining in the downstream part 13*b* after use of the bottle 8, and thus avoid contamination by said product remaining from the product passing in said downstream part during a subsequent use of said bottle.

In order to be able to provide microbiocidal or at least microbiostatic action, the nozzle 12 may in particular be produced from at least one material having microbiocidal or microbiostatic properties, so that said nozzle is active in relation to inhibition while being hostile to microbial development in the product disposed in its vicinity.

According to one embodiment, the microbiocidal or at least microbiostatic properties of the material are obtained by contact of the product with a microbiocidal or at least microbiostatic agent, for example using a metal material such as a copper or zinc alloy or a material comprising at least a filling of such metal particles or one that has undergone surface treatment by fluoridation, galvanising or copper plating.

In particular, the nozzle 12 may comprise copper metal or an alloy based on copper metal which, through its microbiostatic properties, prevents proliferation of or even eliminates the contaminants in contact with said nozzle, and this without migration of any antimicrobial agent into the product. The use of the nozzle 12 then makes it possible to localise the use of copper at the dispensing space without having to copper plate the body 1 of the dispensing head and/or fill it with copper particles.

Particularly advantageously, the nozzle 12 comprises an alloy based on copper, nickel and zinc, in particular the $CuNi_{12}Zn_{24}$ alloy, which also has good properties in terms of machining and corrosion resistance.

In particular, the nozzle 12 may be produced entirely from copper metal or one of the alloys thereof, in particular by forming by pressing a sheet, such a solution having in particular the advantage of being simple and inexpensive to implement.

In a variant, the nozzle 12 may be produced from synthetic material, for example of the polyolefin type, and in particular based on polypropylene (PP), at least one surface of which intended to delimit the dispensing space 13 is metallised with a deposition of copper or one of the alloys thereof.

According to another embodiment, the nozzle 12 is produced from a synthetic material loaded with particles of copper metal with a degree of filling sufficient for the copper particles to be disposed on the surface so as to be in contact with the product.

The microbiocidal or at least microbiostatic properties of the material may also be obtained by the diffusion in the product of an antimicrobial agent, for example on an organic base such as Trichlosan (the trade name of the company Melcoplast) or on a silver base, or mineral. In particular, the material may comprise at least one polyolefin, for example polyethylene (PE), in particular low density (LDPE), polypropylene (PP) and/or polystyrene, which is loaded with at least one antimicrobial agent.

The microbiocidal or at least microbiostatic properties of the material may also be obtained by irradiation of the product with radiation of a suitable wavelength, in particular by means of a material that has photoluminescence properties after exposure to outside light.

In particular, the material may be based on at least one polyolefin, for example low-density polyethylene (LDPE), said polyolefin being loaded with at least one additive able to emit photoluminescent radiation that has a wavelength of between 250 and 260 nanometers, and especially 254 nanometers, which corresponds to the order of magnitude of sterilising ultraviolet radiation.

The invention claimed is:

1. Dispensing head for a system for dispensing a product, said head comprising a body having a well for mounting said head on a tube for the pressurised supply of the product and a recess in communication with said well by means of a dispensing path, said recess being equipped with a nozzle delimiting a dispensing space between said path and a discharge passage formed in said nozzle, said head being characterised in that the nozzle is equipped with an insert that has a membrane forming, in the dispensing space, a communication interface between an upstream part in which the dispensing path emerges and a downstream part that supplies the discharge passage, said membrane being reversibly deformable by the product exerting pressure coming from the upstream part, between a resting state in which the size of the communication interface is minimal and a stressed state in which the size of said interface is increased in order to provide dispensing.

2. Dispensing head according to claim 1, characterised in that the membrane has at least one deformable web that delimits the communication interface with an internal bearing surface of the nozzle, said web being arranged so as to flex by the product exerting pressure thereon while causing a reduction in the external size of said web.

3. Dispensing head according to claim 2, characterised in that the web has an external size at rest that is less than the internal size of the bearing surface in order to prevent said web being put into contact with said bearing surface.

4. Dispensing head according to claim 2, characterised in that the membrane has at least two webs each extending over an angular sector, said webs being separated angularly by a bridge, the rigidity of which is greater than that of said webs in order not to flex by the product exerting pressure thereon.

5. Dispensing head according to claim 2, characterised in that the web has bellows for controlling the deformation of said web by the product exerting pressure thereon.

6. Dispensing head according to claim 1, characterised in that the insert has a central stud around which the membrane extends radially.

7. Dispensing head according to claim 6, characterised in that the dispensing path emerges axially opposite the stud.

8. Dispensing head according to claim 1, characterised in that the recess is provided with an abutment around which the nozzle is mounted in order to delimit the dispensing space, said abutment having at least one conduit in which at least part of the dispensing path extends.

9. Dispensing head according to claim 8, characterised in that the conduit extends axially in the central part of the abutment.

10. Dispensing head according to claim 1, characterised in that the nozzle has a distal wall in which the discharge passage is formed, and a lateral wall having an internal bearing surface delimiting the communication interface.

11. Dispensing head according to claim 10, characterised in that the insert has at least one front stop that is in axial abutment on the inside of the distal wall.

12. Dispensing head according to claim 10, characterised in that the membrane in the stressed state is arranged so as to come into axial abutment on the inside of the distal wall while maintaining the communication interface between said abutment and said wall.

13. Dispensing head according to claim 1, characterised in that the nozzle is produced from at least one material having microbiocidal or at least microbiostatic properties by diffusion of an antimicrobial agent, by contact with a microbiocidal or at least microbiostatic agent and/or by irradiation with radiation of a suitable wavelength.

14. Dispensing head according to claim 13, characterised in that the nozzle comprises copper metal or an alloy based on copper metal.

15. Dispensing head according to claim 1, characterised in that the insert is able to provide microbiocidal or at least microbiostatic action on the product contained at least at the communication interface.

16. Dispensing head according to claim 1, characterised in that the discharge passage has an opening that is delimited by a lateral wall provided with at least one internal projection.

17. System for dispensing a product, said system comprising a dispensing head according to claim 1 and a tube for the pressurised supply of the product, on which the mounting well of said head is fixed.

18. Dispensing system according to claim 17, characterised in that it comprises a pump actuated by the dispensing head, said pump comprising the tube for the pressurised supply of the product.

19. Bottle comprising a container in which a product is intended to be packaged, said container being equipped with a dispensing system according to claim 17 that is mounted so as to put the supply tube in communication with said container in order to allow the product to be conveyed from said supply tube to the discharge passage.

* * * * *